US005147189A

United States Patent [19]

Barnowski

[11] Patent Number: 5,147,189

[45] Date of Patent: Sep. 15, 1992

[54] PRESSURE PUMP WITH SEALING SLEEVE BETWEEN HEAD AND CHAMBER

[75] Inventor: Ulrich Barnowski, Olelde, Fed. Rep. of Germany

[73] Assignee: Paul Hammelmann Maschinenfabrik GmbH, Oelde, Fed. Rep. of Germany

[21] Appl. No.: 743,286

[22] PCT Filed: Jan. 11, 1991

[86] PCT No.: PCT/DE91/00020

§ 371 Date: Oct. 31, 1991

§ 102(e) Date: Oct. 31, 1991

[87] PCT Pub. No.: WO91/10830

PCT Pub. Date: Jul. 25, 1991

[30] Foreign Application Priority Data

Jan. 18, 1990 [DE] Fed. Rep. of Germany ..... 4001335

[51] Int. Cl.[5] ..... F04B 21/06

[52] U.S. Cl. ..... 417/567; 417/571

[58] Field of Search ..... 417/567, 571; 92/168, 92/165, 66

[56] References Cited

U.S. PATENT DOCUMENTS 4,174,194 11/1979 Hammelmann ..... 417/567

FOREIGN PATENT DOCUMENTS 471279 3/1927 Fed. Rep. of Germany ..... 417/571

1576912 8/1969 France ..... 417/571

*Primary Examiner*—Leonard E. Smith

*Assistant Examiner*—Roland McAndrews

*Attorney, Agent, or Firm*—Sprung Horn Kramer & Woods

[57] ABSTRACT

A maximum-pressure plunger plump has, coaxial with its longitudinal axis, a compression valve and a suction valve. It has a sleeve that floats on a plunger. The sleeve rests on the end facing the head of the pump on an inset. the inset is provided with a seat area for the body of the suction valve and with suction channels. The sleeve has a bushing. The suction valve is in a form of a disk. It has a spring-loaded annular body that rests on the valve-seat area that the suction channels open out of in the insert in the pump head.

The plunger's bushing (9) extends to th eend of the sleeve (7) that faces the head (2) of the pump with its face against the insert (12) and in that a sealing sleeve (15) that overlaps the area or seam of impact between the insert and the sleeve is accommodated in the flow channel between the bushing and the insert.

8 Claims, 2 Drawing Sheets

PRESSURE PUMP WITH SEALING SLEEVE BETWEEN HEAD AND CHAMBER

Figure 1:
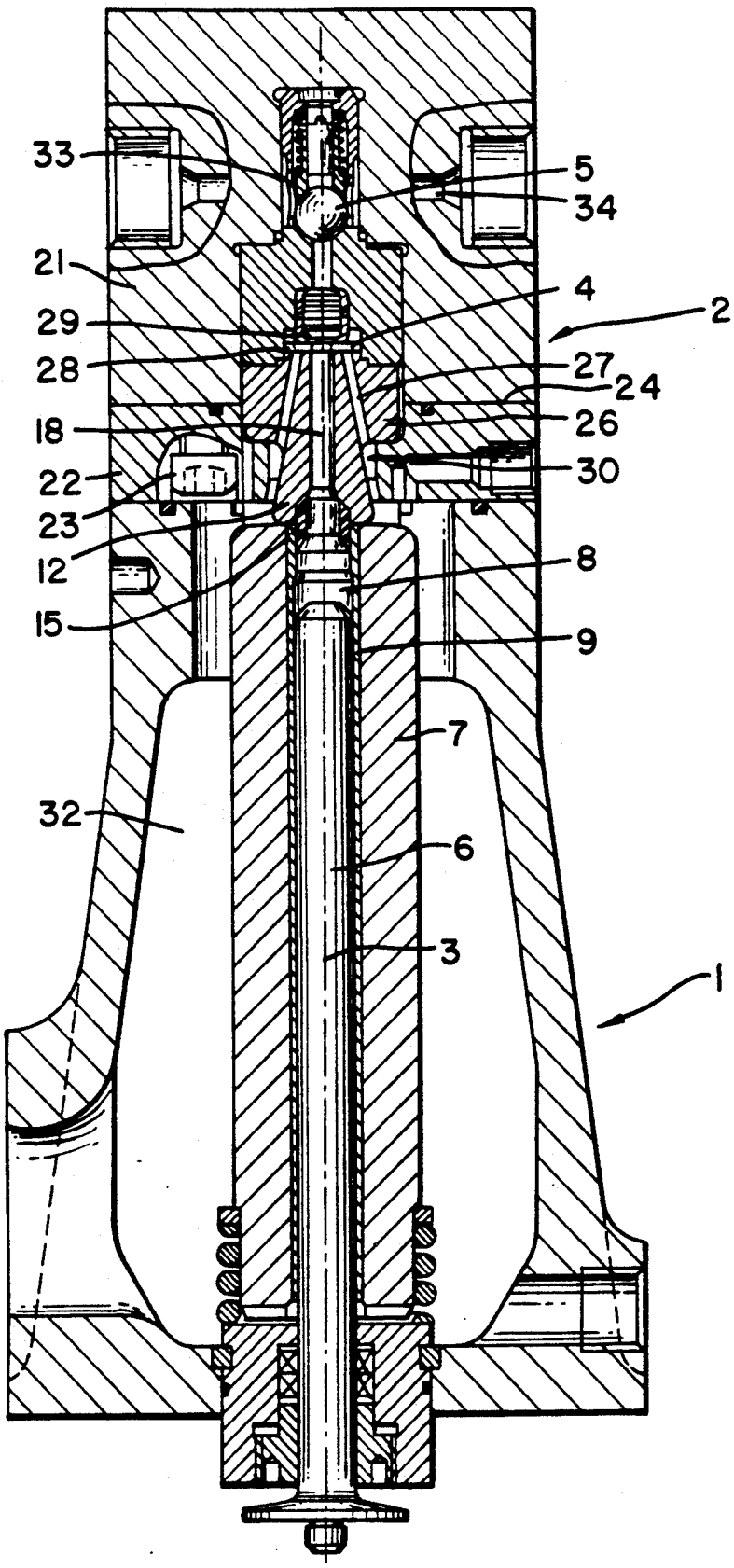

The invention concerns a maximum-pressure plunger pump with, coaxial with its longitudinal axis, a compression valve and a suction valve, with a sleeve that floats on a plunger and rests on the end facing the head of the pump on an inset provided with a seat area for the body of the suction valve and with suction channels, whereby the sleeve has a bushing and the suction valve is in the form of a disk with a spring-loaded annular body that rests on the valve-seat area that the suction channels open out of in the insert in the pump head.

A maximum-pressure plunger pump of this genus is known (U.S. Pat. No. 4 174 194). The end of the sleeve that faces the pump head tapers conically in, and the plunger's bushing extends only over the sleeve's cylinder section.

This pump can be used at pressures of up to approximately 1000 bars. At higher pressures, the hydraulic force on the face of the bushing is so powerful that it overcomes the force of adhesion between the bushing and the sleeve. The components become mutually displaced and lead to malfunction.

Compression medium can also penetrate between the bushing and the sleeve, forcing the bushing against the plunger and also resulting in malfunction.

Furthermore, a high surface-to-surface pressure must be maintained between the face of the sleeve and the insert to generate a metallic seal.

The object of the present invention is a maximum-pressure plunger pump of the aforesaid genus that can be operated at pressures of 2000 to 4000 bars on the transition between the sleeve and the insert with little stress on either.

This object is attained in accordance with the invention in that the plunger's bushing extends to the end of the sleeve that faces the head of the pump with its face against the insert and in that a sealing sleeve that overlaps the area of impact between the insert and the sleeve is accommodated in the flow channel demarcated by the bushing and the insert.

The position of the sealing sleeve severely decreases the surface-to-surface pressure in the vicinity of the area of impact between the insert and the sleeve that surrounds the plunger because the pressure of the fluid being conveyed acts toward the area of impact on only a small annular area on the bushing. In the absence of such a sealing sleeve, the materials, even extremely high-quality steels, will reach the limits of their strength very rapidly because a very high surface-to-surface pressure will be required to create a seal at the area of impact.

The sleeve and bushing can also be manufactured as a single unit if a material can be found that simultaneously possesses enough reversed-stresses fatigue strength for the sleeve and the sliding and emergency-operations properties needed for the bushing.

The design in accordance with the invention considerably diminishes the stresses on these components. Depending in fact on the shape of the sealing sleeve and on how thick its wall is, for example, the stresses can be decreased by one half.

Another effect of the sealing sleeve is that it prevents pressure medium from leaking out through the seam between the face of the sleeve around the plunger and the insert, preventing the medium from inducing wear in the aforesaid components that surround the joint.

Further characteristics of the invention will be evident from the subsidiary claims.

Figure 2:
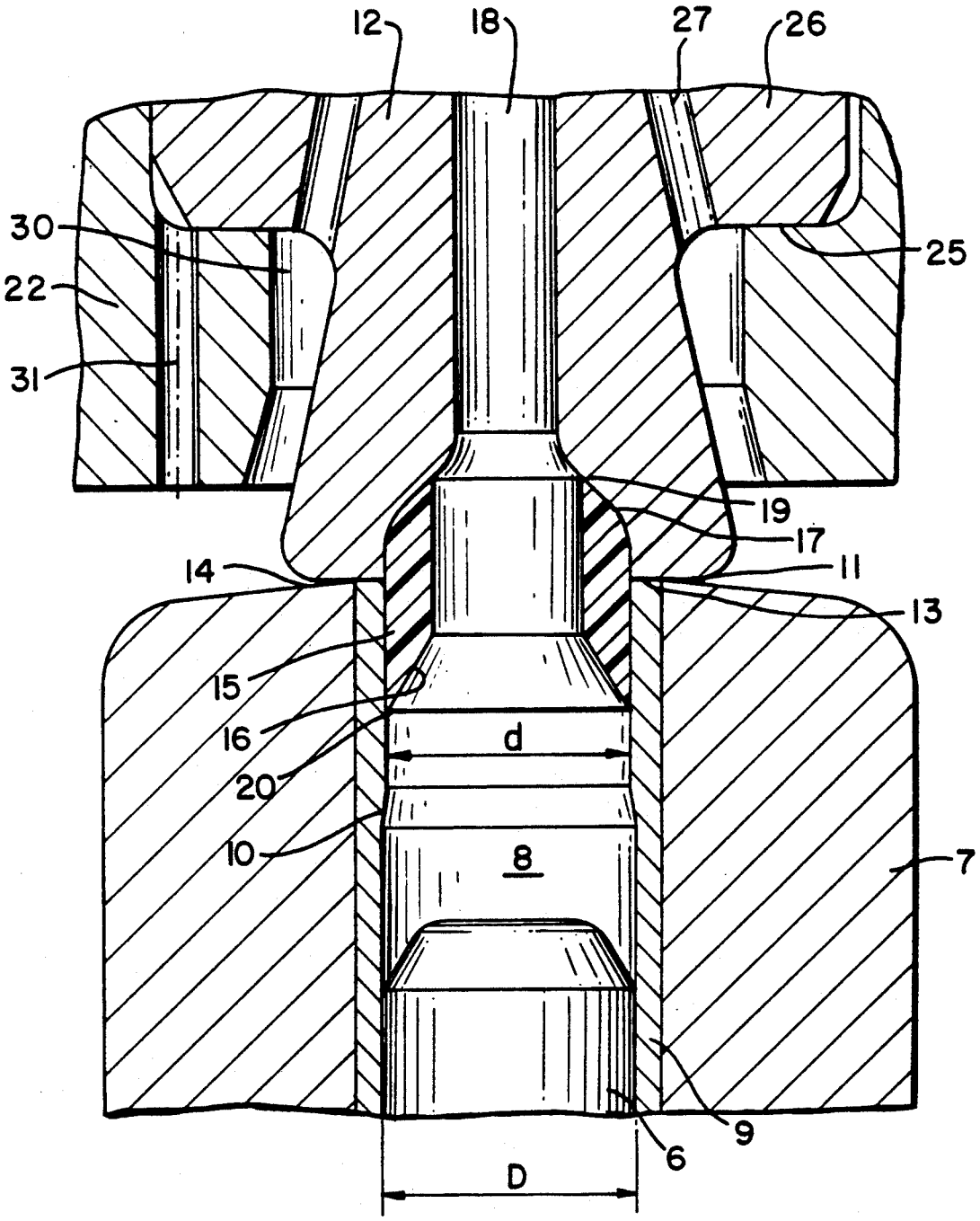

One embodiment of the invention will now be specified with reference to the drawing, wherein FIG. 1 is a longitudinal section through a maximum-pressure plunger pump and FIG. 2 is an enlarged detail of FIG. 1.

The maximum-pressure plunger pump illustrated in FIG. 1 consists essentially of a housing 1, a head 2 that is connected to the housing, a suction valve 4 and compression valve 5 that are coaxial with the pump's longitudinal axis 3, and a sleeve 7 that floats on a plunger 6 with a bushing 9 in its cylindrical bore 8. The plunger travels back and forth in the bushing.

Bushing 9 extends over the total length of sleeve 7. In the vicinity of the motion of plunger 6, the bushing has an inside diameter D, and, in the vicinity of the end of the sleeve facing the pump head, an inside diameter d.

The ratio between diameters D and d is approximately 1:0.9. At the transition between inside diameter D and inside diameter d is a hydraulically active area 10, which is subject to the pressure of the fluid being conveyed during the forward stroke, producing a force that displaces bushing 9 against the area 11 of impact of an insert 12. Area 11 of impact demarcates in conjunction with the face 13 of bushing 9 and the face 14 of sleeve 7 an impact seam that is overlapped by a sealing sleeve 15 inserted in the flow channel demarcated by bushing 9 and insert 12.

Sealing sleeve 15 has conical faces 16 and 17. The section of sealing sleeve 15 that extends into insert 12 is accommodated in a depression that extends out of area 11 of impact and tapers conically into a smaller-diameter duct 18 at the end facing away from sleeve 7.

To ensure that sealing sleeve 15 will function properly, the angles in insert 12 and sealing sleeve 15 allow initial annular contact between the sleeve and the insert only at level 19. Furthermore, the diameters of bushing 9 and sealing sleeve 15 produce an annular seal at level 20.

As will be evident from FIG. 1, head 2 comprises components 21 and 22, which are secured together by screws 23 and further secured to housing 1. Components 21 and 22 are separated by a plane 24 that extends perpendicular to longitudinal axis 3.

The component 22 of head 2 that faces housing 1 has a surface 25 that supports an annular flange 26 on insert 12.

Insert 12 has suction channels 27 that extend from a valve-seat area 28 on disk-shaped suction-valve body 29 to the lower demarcating surface of annular flange 26 and open into an annular channel 30 demarcated by insert 12 and by the component 22 of head 2 that faces housing 1.

At least one leakage channel 31 extends from the supporting surface 25 on component 22 to a suction compartment 32.

When plunger 6 executes its suction stroke, it produces a vacuum in the pump's cylindrical bore 8, lifting suction-valve body 29 out of the way and allowing the fluid being conveyed to flow out of suction compartment 32, through suction channels 27, and into the bore. During the compression stroke, suction-valve body 29 will, subject to the force of the spring, close off suction channels 27, so that the fluid can access compression valve 5 by way of duct 18, lifting a valve body 33 from its seat and arriving at the associated appliance.

I claim:

1. Maximum-pressure plunger pump with, coaxial with its longitudinal axis, a compression valve and a suction valve, with a sleeve that floats on a plunger and rests on the end facing the head of the pump on an inset provided with a seat area for the body of the suction valve and with suction channels, whereby the sleeve has a sliding bushing and the suction valve is in the form of a disk with a spring-loaded annular body that rests on the valve-seat area that the suction channels open out of in the insert in the pump head, characterized in that the plunger's sliding bushing (9) extends to the end of the sleeve (7) that faces the head (2) of the pump with its face against the insert (12) and in that a sealing sleeve (15) that overlaps the area or seam of impact between the insert and the sleeve is accommodated in the flow channel demarcated by the bushing and the insert.

2. Maximum-pressure plunger pump as in claim 1, characterized in that the sleeve (7) and the bushing (9) are in one piece.

3. Maximum-pressure plunger pump as in claim 1, characterized in that the sealing sleeve (15) has conical faces (16 & 17) and the section of the sealing sleeve that extends into the insert (12) is accommodated in a depression that extends out of the area (11) of impact and tapers conically into a smaller-diameter duct (18) at the end facing away from the sleeve (7).

4. Maximum-pressure plunger pump as in claim 1 or 3, characterized in that the bushing has an inside diameter D, and, in the vicinity of the end of the sleeve facing the pump head, an inside diameter d, the ratio between the diameters (D & d) is approximately 1:0.9.

5. Maximum-pressure plunger pump as in claim 1, characterized in that the head (2) comprises two components (21 & 22) separated by a plane (24) that extends perpendicular to the longitudinal axis (3).

6. Maximum-pressure plunger pump as in claim 5, characterized in that the component (22) of the head (2) that faces the (housing 1) has a supporting surface (25) that supports an annular flange (26) on the insert (12).

7. Maximum-pressure plunger pump as in claim 6, characterized in that the suction channels (27) extend from the valve-seat area (28) to the lower surface of the annular flange (26) and open into an annular channel (30) between the insert (12) and by one component (22) of the head (2).

8. Maximum-pressure plunger pump as in claim 6, characterized in that at least one leakage channel (31) extends from the supporting surface (25) to the suction compartment (32).

* * * * *